US005865323A

United States Patent [19]

Lecroy

[11] Patent Number: 5,865,323

[45] Date of Patent: Feb. 2, 1999

[54] GLIDE RACK INSERT

[75] Inventor: Danny Lecroy, Centre, Ala.

[73] Assignee: Rehrig-Pacific Company, Inc., Los Angeles, Calif.

[21] Appl. No.: 720,800

[22] Filed: Oct. 1, 1996

[51] Int. Cl.[6] ..... A47F 5/00

[52] U.S. Cl. ..... 211/59.2; 211/74; 211/183

[58] Field of Search ..... 211/59.2, 74, 183; 312/42

[56] References Cited

U.S. PATENT DOCUMENTS

| | | | |
|---|---|---|---|
| 4,314,648 | 2/1982 | Spamer | 211/59.2 |
| 4,565,725 | 1/1986 | Spamer et al. | 211/59.2 X |
| 4,809,855 | 3/1989 | Bustos | 211/59.2 |
| 4,947,999 | 8/1990 | Warp | 211/183 |
| 4,960,210 | 10/1990 | Spamer | 211/59.2 |
| 5,022,535 | 6/1991 | Spamer | 211/59.2 |
| 5,050,748 | 9/1991 | Taub | 211/59.2 |
| 5,197,610 | 3/1993 | Bustos | 211/59.2 |
| 5,205,421 | 4/1993 | Bustos | 211/59.2 |
| 5,614,288 | 3/1997 | Bustos | 211/59.2 X |
| 5,695,076 | 12/1997 | Jay | 211/59.2 |
| 5,695,077 | 12/1997 | Jay | 211/59.2 |

OTHER PUBLICATIONS

Retro–Track™ advertisement of Display Technologies, *Beverage World*, Oct., 1996, p. 27.

*Primary Examiner*—Robert W. Gibson, Jr.
*Attorney, Agent, or Firm*—Banner & Witcoff, Ltd.

[57] ABSTRACT

The present invention provides an insert for a glide rack, with the insert being dimensioned to correspond to the given length and width of a row of the glide rack. The insert is fitted within the row of the glide rack such that the glide characteristics of the row of the glide rack are improved and the containers slide more easily toward the forward end thereof. The insert is preferably manufactured from a high density polyethylene.

15 Claims, 2 Drawing Sheets

GLIDE RACK INSERT

TECHNICAL FIELD

The present invention relates to an improvement for glide racks or display racks used in refrigerated beverage display cases, and in particular, an insert positionable in each glide rack row to thereby prolong the useful life of the glide rack.

BACKGROUND OF THE INVENTION

Refrigerated display cases for beverage containers, and the like, generally include vertically aligned rows of racks, commonly called glide racks, upon which the beverage containers are loaded. The beverage containers may be cans or bottles of any size and the width of the glide rack rows are adjusted accordingly to accommodate each particular container. Glide racks may also be used for gallon jugs of a beverage, such as milk, or for any other type of container that may displayed for sale within a refrigerated case. Referring to FIG. 1, a typical prior art glide rack is shown generally be reference number 10. The glide rack includes a plurality of rows 12 extending from the front 14 of the glide rack to the rear 16 thereof Each row may then be loaded with rows of beverage containers 18 extending from the front of the display case to the rear of the display case. Each glide rack is disposed within the refrigerated display case at an angle of approximately five to twelve degrees. Thus, when the forwardmost beverage container 18' is removed from the row 12 by a consumer, the next beverage container 18" will move forward to occupy the forwardmost position, and the remainder of the row of beverage containers will follow. In this manner, there is always a beverage container at the front of each row of the glide rack ready to be dispensed to a consumer.

As shown in FIG. 1, the support surface 20 of each row 12 of the glide rack includes a plurality of slots extending therethrough. These slots allow any spillage that may occur from the beverage containers to drain to the bottom of the display case. The slots also reduce the surface area of the support surface 20 so that there is less contact with the beverage containers and they therefore slide more easily. Prior art glide racks are currently manufactured using a high density polyethylene with a silicone plasticizer. When the racks are poured the resultant plastic material has a directional grain and the silicone is disposed on the exposed surfaces of the glide rack, including the support surface 20, in order to assist the beverage containers in gliding. However, the silicone easily wears off the bottom surface as the beverage containers slide therealong thus decreasing the glidability of the beverage containers.

As the silicone on the sliding surface of the glide rack wears off, more friction is created by the sliding of the beverage containers thereon and the plastic sliding surface of the glide rack becomes more roughened. This in turn creates more problems as the beverage containers may fall over, tip, rotate, occasionally open and spill. The repeated sliding along the roughened sliding surface and the beverage containers tipping and spilling creates a worn and unusable glide rack within only three to four months of use. In the past, it has been necessary to completely replace the entire glide rack once it reached this point of wear and tear, resulting in costly and repeated expenditures.

Accordingly, there is a strong need for a glide rack improvement enabling prior art glide racks to be used for an extended period of time after the initial silicone coating has worn away.

SUMMARY OF THE INVENTION

The present invention overcomes these disadvantages of the prior art by providing an insert for the glide rack, with the insert being dimensioned to correspond to the given length and width of a row of the glide rack. The insert is fitted within the row of the glide rack such that the glide characteristics of the row of the glide rack are improved and the containers slide more easily toward the forward end thereof. The insert is preferably manufactured from a high density polyethylene and has at least a mechanically roughened upper glide surface. The insert further preferably includes a forward end and a rear end, the forward end being rounded to generally correspond to a forward end of the row of the glide rack. The rear end preferably has a central region generally abutting a rear end of the glide rack row and angled corners disposed on each side of the central region, the angled corners exposing the glide rack row therebeneath and facilitating the easy removal of the insert from the glide rack row.

The present invention further provides a method of making an insert for a glide rack, the method including the steps of providing a sheet of plastic material, cutting the insert from the sheet of plastic material, the insert being dimensioned to fit within an individual row of the glide rack, and providing a mechanically roughened surface for an upper glide surface of the insert. The textured surface may be provided by sanding the insert after it is cut from the sheet of plastic material. The sanding is performed unidirectionally in the direction of the desired glide of a container along the insert.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of invention.

DETAILED DESCRIPTION OF THE PREFERRED EMBODIMENTS

Figure 1:
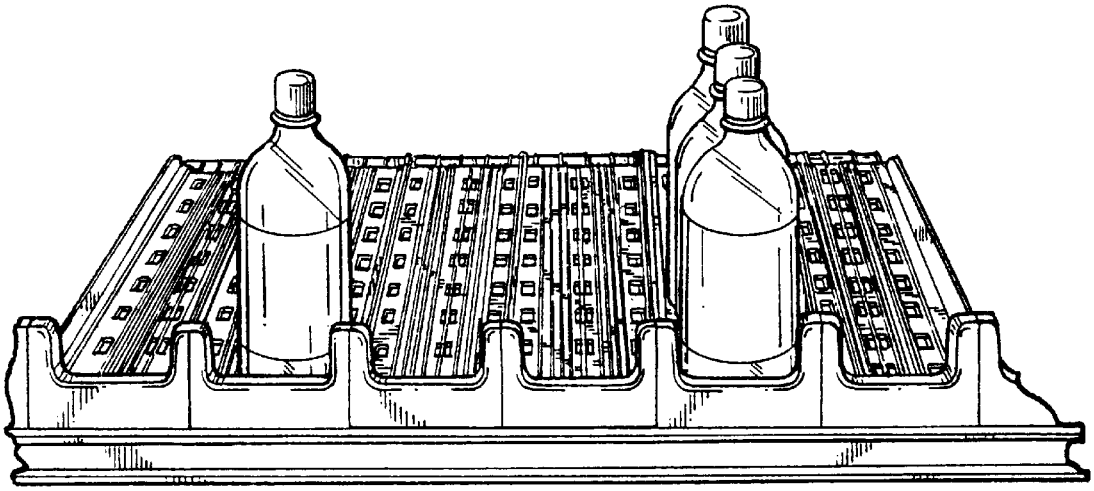
FIG. 1 PRIOR ART
FIG. 1 is a front elevational view of a glide rack according to the prior art.
Figure 2:
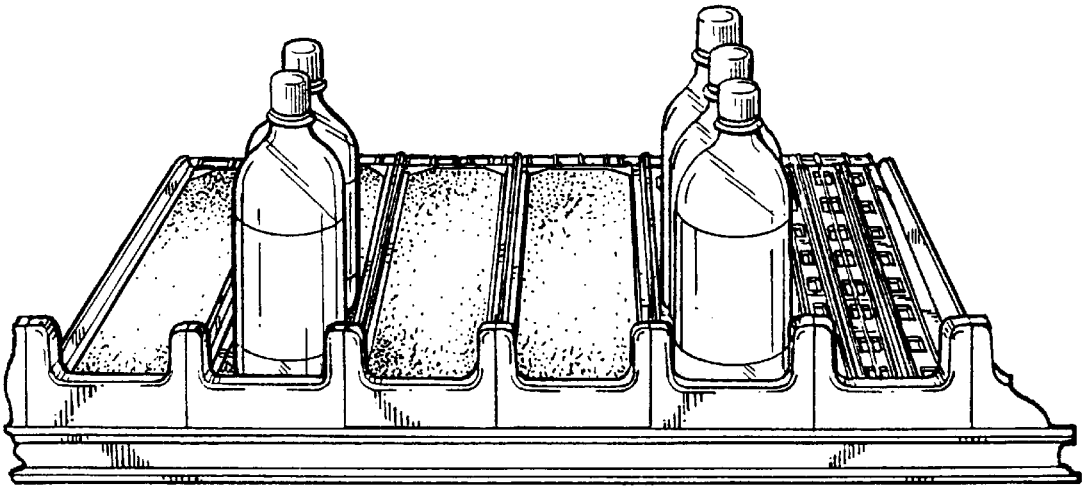
FIG. 2 is a front elevational view thereof including a glide rack insert in accordance with a preferred embodiment of the present invention.

A glide rack insert in accordance with of the present invent ion is shown generally by reference numeral 30 in FIG. 2. Glide rack insert 30 is dimensioned according to the width and length of the rows 12 of a standard prior art glide rack 10. A glide rack insert 30 is preferably positioned within each row 12 of the glide rack and thereby replaces the worn and torn support surface 20 of the original glide rack. As discussed in detail below, glide rack insert 30 enables the useful life of glide rack to be significantly extended merely by retrofitting an insert 30 into each row. Insert 30 is specifically manufactured to facilitate a smooth gliding motion of the beverage containers as the forwardmost container is removed and when the rows are originally stocked with the chosen beverage.

Figure 3:
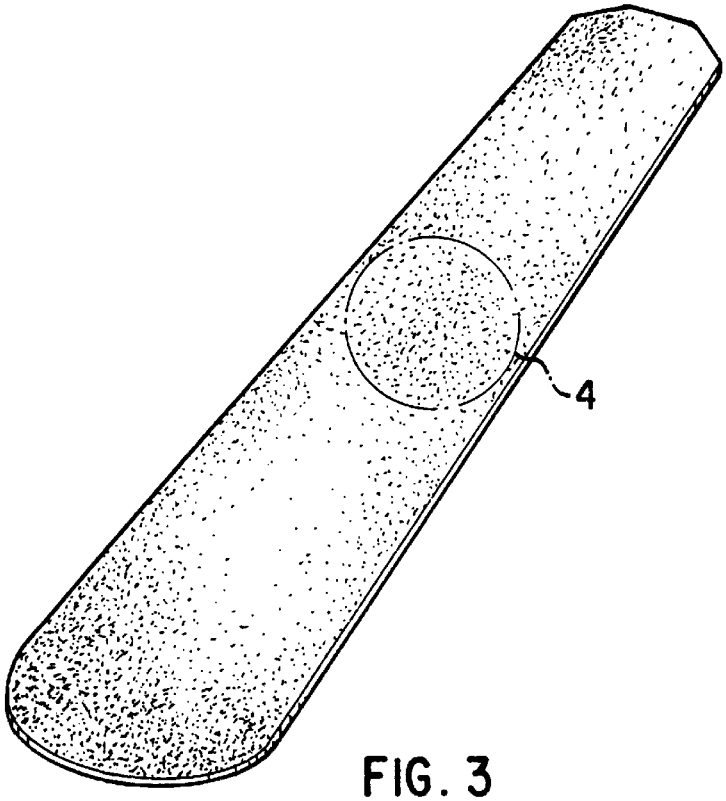
FIG. 3 is a perspective view of the glide rack insert shown in FIG. 2.

Referring also to FIG. 3, glide rack insert 30 has a preferred length "1" of approximately 23.125 inches and a width "w" between approximately 2.5–3.5 inches, depending upon the width of the glide rack. In addition, lengths up to 36 inches or 48 inches may also be made if the length of the subject glide rack so demands. The preferred thickness "t" of insert 30 is approximately 60–65 mil, preferably 65 mil. The glide rack 10 includes raised runners 22 extending the length thereof that define the individual rows 12. Thus, glide rack insert 30 quickly and easily may be inserted between adjacent runners 22 and securely held therebetween. The forward end 32 is preferably rounded with a radius of curvature "r" being approximately 1.25 inches. The rounded forward end 32 generally conforms to the configuration of the front 12 of glide rack 10 and further assures a secure fit of insert 30 within each row 12. The rear end 34 of insert 30 generally corresponds to a truncated triangle, with the central section 36 having a length "cs" of approximately 1.25–1.75 inches, respectively, depending on the overall width "w" of the glide rack insert. The truncated side portions 38 of the rear end define the hypotenuse of an equilateral triangle having legs "t1" of approximately 0.625–0.875 inches, respectively, again depending of the overall width "w" of the glide rack insert. The truncated side portions 38 provide access to the rear end 34 of the insert 30 when it is desired to remove insert 30 from the glide rack. That is, insert 30 fits securely between adjacent runners and must be manually lifted out of the row 12. The truncated side portions 38 provide enough room for a person to place a finger or screwdriver under the insert 30 and thereby remove it from the row.

Glide rack insert 30 is preferably cut by a die mold from a roll or sheet of an extruded sheet of high density polyethylene (HDPE). HDPE has the advantages of being lightweight, having a low moisture absorption, high tensile strength, excellent impact resistance, and it is non-toxic and non-staining. The glide characteristics of the HDPE are an improvement over conventional glide rack plastics since the extruded sheet of HDPE does not contain a directional grain as found in conventional injection molded or poured glide racks. The preferred HDPE is available from Primex located in Richmond, Indiana, and has the following physical properties: melt index of 0.3–0.8 g/10 min.; density of0.955 g/cm$^3$; tensile strength at yield of 4600 psi; tensile elongation at yield of 900%; IZOD Impact Notches at 73° F. of 3 ft-lb/in; hardness of 69 Shore D; heat deflection temperature at 264 psi of 110–130; and water absorption of a ⅛" thick specimen at twenty-four hours of 0%. The preferred HDPE is a highly abradable plastic and thus the beverage containers sliding along the insert 30 quickly form a natural path or groove in the insert and thereby further increase the glide performance of the insert. Other high density polyethylenes and other plastic materials could of course be used with varying degrees acceptability. The preferred HDPE has been found to provide the most cost efficient glide rack insert having the most satisfactory glide performance characteristics.

Figure 4:
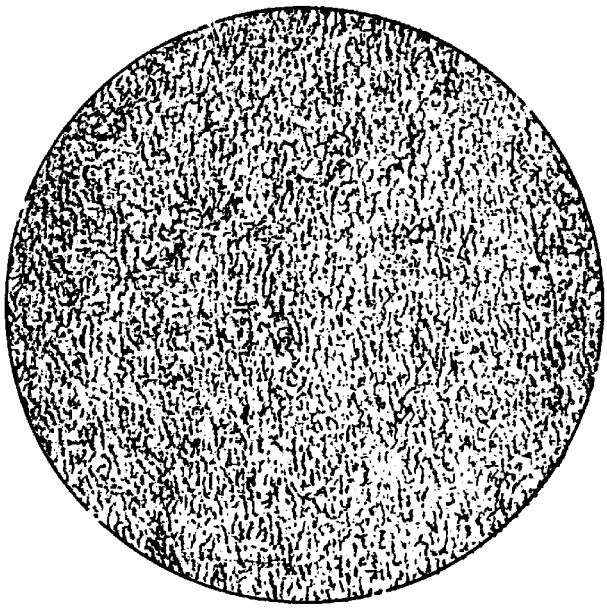
FIG. 4 is an enlarged view of a portion of the glide rack shown by circle 4 in FIG. 3.

Referring also to FIG. 4, glide rack insert 30 includes a roughened upper surface 40 upon which the beverage containers are disposed. The roughened upper surface may be formed or by sanding, as described in further detail below. The present invention utilizes the roughened surface to reduce the friction between the beverage containers and the glide rack insert and thereby increase the glide characteristics of insert 30.

The present invention can thus refurbish a worn glide rack after the initial silicone coating has worn away from the bottom surface 20 and the desired gliding motion of the beverages containers has decreased. A glide rack insert 30 is selected with the correct width corresponding to each row of the worn glide rack. Insert 30 is secured within the row between adjacent runners and the beverage containers are then loaded into the row on top of insert 30. The sliding of the beverage containers along the row forms a natural groove or abraded path within the textured upper surface 40 of the insert. Thus, the more insert 30 is used, the better the gliding that is achieved. That is, as more and more beverage containers slide down the glide rack row and dust and grit become present on the insert during use, the more defined the natural abraded path is going to become. Therefore, the more defined the path becomes, the more the glide characteristics of the insert 30 will increase.

The glide rack insert is cut by a die mold from a roll or sheet of an extruded sheet of high density polyethylene (HDPE). The HDPE material does not have any imprinted pattern in this embodiment and both the upper and lower surfaces have a generally shiny surface. To improve the glide characteristics of the glide rack insert, the insert is sanded, unidirectionally, in the direction of the desired glide. The sanding is preferably performed using a fine grit, i.e., 400 or more, sandpaper, and more preferably, a wet/dry sandpaper. The glide rack insert is sufficiently sanded when the shiny surface of the HDPE material has been abraded on the sliding surface thereof. The sanding of the upper glide surface creates a roughened surface for contacting the containers and further abrades with the natural flow path of the containers in the glide rack row.

From the foregoing detailed description, it will be evident that there are a number of changes, adaptations and modifications of the present invention which come within the province of those persons having ordinary skill in the art to which the aforementioned invention pertains. For example, the present glide racks can be adapted to handle bottles, cans, jugs or other types of articles of different sizes, widths, numbers or materials other than those set forth herein. However, it is intended that all such variations not departing from the spirit of the invention be considered as within the scope thereof as limited solely by the appended claims.

I claim:

1. In a glide rack for maintaining a plurality of containers in proper positions for dispensing to a user, the glide rack including at least one inclined row in which the containers are aligned and glide toward the forward end of the row when the forwardmost container in the row is removed therefrom, the row having an elongated plastic insert in the bottom thereof which supports the containers, the improvement wherein said insert is flat and has a mechanically roughened upper surface on which the containers glide.

2. The glide rack of claim 1 wherein said insert has a homogeneous composition.

3. The improvement of claim 2 wherein said insert has a roughened upper surface on which containers are disposed.

4. The glide rack of claim 3 wherein said insert is made of high density polyethylene.

5. An insert for a container glide rack of the type having at least one inclined row in which containers are aligned and supported on the insert so that the containers glide forward when the forwardmost container in the row is removed therefrom, the insert comprising a flat, elongated plastic member dimensioned and adapted to fit into the bottom of the row, and having a mechanically roughened surface pattern on the upper surface thereof on which the containers glide.

6. The insert of claim 5 wherein said insert has a homogeneous composition.

7. The insert of claim 6 wherein said upper surface of said insert has a roughened surface pattern that is substantially aligned with the length of said insert.

8. The glide rack of claim 7 wherein said insert is made of high density polyethylene.

9. A method of making an elongated plastic insert for a glide rack of the type having at least one inclined row in which containers are aligned and supported on the insert so that the containers glide forward when the forwardmost container in the row is removed therefrom, the method comprising the steps of:

cutting the insert from a flat sheet of plastic material in a length and width that will allow the insert to fit into the bottom of the row; and mechanically roughening the upper container-supporting surface of the insert, thereby enhancing the glide characteristics thereof.

10. The method of claim 9 wherein the sheet of plastic material has a homogeneous composition.

11. The method of claim 10 wherein the step of roughening the upper surface of the insert comprises forming a roughened surface pattern that is substantially aligned with the length of the insert.

12. The method of claim 11 wherein the sheet of plastic material is high density polyethylene.

13. The method of claim 9 wherein said step of providing a roughened surface comprises sanding the insert after it is cut from the sheet of plastic material.

14. The method of claim 13 wherein said sanding step includes unidirectionally sanding the insert in the direction of the desired glide of a container along the insert.

15. The method of claim 14 wherein said sanding step further includes using a fine grit wet/dry sand paper.

* * * * *

UNITED STATES PATENT AND TRADEMARK OFFICE

CERTIFICATE OF CORRECTION

PATENT NO. : 5,865,323

DATED : February 2, 1999

INVENTOR(S) : Danny Lecroy

It is certified that error appears in the above-identified patent and that said Letters Patent is hereby corrected as shown below:

Claim 3 should read:

3. The glide rack of claim 2 wherein said upper surface of said insert has a roughened surface pattern that is substantially aligned with the length of said insert.

Signed and Sealed this

Sixth Day of July, 1999

*Attest:*

Q. TODD DICKINSON

*Attesting Officer*

*Acting Commissioner of Patents and Trademarks*